United States Patent [19]

Esselborn et al.

[11] Patent Number: 4,880,906

[45] Date of Patent: Nov. 14, 1989

[54] FIBER FINISHING AGENTS AND COMPOSITIONS CONTAINING THEM

[75] Inventors: Eberhard Esselborn, Essen; Jürgen Fock, Duesseldorf, both of Fed. Rep. of Germany

[73] Assignee: Th. Goldschmidt AG, Essen, Fed. Rep. of Germany

[21] Appl. No.: 219,715

[22] Filed: Jul. 15, 1988

[30] Foreign Application Priority Data

Jul. 15, 1987 [DE] Fed. Rep. of Germany ..... 3723349

[51] Int. Cl.[4] ..... C08G 59/02

[52] U.S. Cl. ..... 528/403; 528/405; 528/421; 528/48; 528/491; 528/494; 528/503; 252/8.8; 252/8.9; 427/385.5; 427/386; 427/388.2; 427/388.4; 428/364; 428/374; 527/601; 527/603

[58] Field of Search ..... 252/8.8, 8.9; 427/385.5, 386, 388.2, 388.4; 428/364, 374; 527/601, 603; 528/403, 405, 421, 481, 491, 494, 503

[56] References Cited

U.S. PATENT DOCUMENTS 4,542,173 9/1985 Schupp et al. ..... 523/414

FOREIGN PATENT DOCUMENTS 3244011 5/1984 Fed. Rep. of Germany .
2643637 2/1985 Fed. Rep. of Germany .

*Primary Examiner*—John Kight
*Assistant Examiner*—Samuel A. Acquah
*Attorney, Agent, or Firm*—Toren, McGeady & Associates

[57] ABSTRACT

A finishing agent for finishing fibers or fiber products is disclosed. The agent is a mixture of the following components:

(a) 34 to 99% by weight of a polymer of the general formula

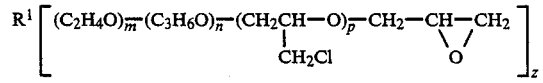

in which $R^1$ is a z-hybric aliphatic alcohol, z=2 to 9, m=20 to 75, n=0 to 10, p=0 to 3, (b) 0 to 55% by weight of a copolymer, obtained by copolymerization of ($b_1$) one mole of a macromonomer of the general formula

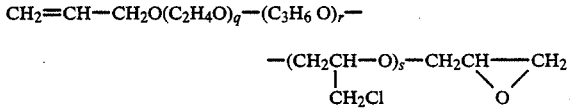

in which q=5 to 75, r=0 to 10, s=0 to 3, with ($b_2$) 2 to 12 moles of a vinyl ester of the general formula $CH_2{=}CHOCOR^2$, in which $R^2$ is an alkyl group with 1 to 4 carbon atoms, ($b_3$) 1 to 6 moles of N-vinylpyrrolidone, ($b_4$) 0 to 6 moles of an acrylate or methacrylate ester of the general formula $CH_3{=}CR^3{-}COOR^4$, in which $R^3$=H or $CH_3$, $R^4$ is an alkyl group with 1 to 4 carbon atoms, the quotient of the average molecular weight of the monomer ($b_1$) and the number of moles of the monomers ($b_2$), ($b_3$) and ($b_4$) being 20 to 500 and (c) 1 to 35% by weight of a compound, which is reactive with respect to the oxiran group and brings about the cross linking reaction, the sum of the components (a), (b) and (c) yielding 100% by weight.

Especially preferred is a finishing agent mixture of
34 to 73% by weight of component (a)
24 to 55% by weight of component (b) and
2 to 30% by weight of component (c)

the sum of components (a), (b) and (c) yielding 100% by weight.

The invention also discloses a finishing composition in the form of an aqueous solution comprising 0.1 to 10% by weight of the finishing agent as active ingredient with the remainder being water. A method for fixing fibers and fiber products with the inventive composition is also disclosed.

The finishing agent and composition of the invention improve the handle, the hydrophilicity and the soil release of treated textile material. At the same time, the soilability, graying and the tendency to develop electrostatic charges are reduced.

13 Claims, No Drawings

FIBER FINISHING AGENTS AND COMPOSITIONS CONTAINING THEM

FIELD OF INVENTION

The invention generally relates to the finishing of fibers and fiber products and is particularly directed to novel fiber finishing agents as well as compositions containing such agents as effective ingredient. The inventive agents and compositions are particularly suitable for imparting fibers and fiber products with improved handle or touch while at the same time resulting in superior permanence of the finish.

BACKGROUND INFORMATION AND PRIOR ART

It is well known that polymers may be applied to the surfaces of fibers or fiber products in order to change and enhance their properties in a desired manner. By such a treatment, properties such as the handle or touch of the textile material, its hydrophilicity, antistatic behavior, soilability or the removal of soil from the textile material can be improved in a desired manner. To a certain degree, these property changes are interdependent. It may therefore, frequently be observed that, when there is an improvement in one property, a deterioration in a different property must be accepted. For example, an improvement in crease resistance frequently is at the expense of a worsening of the handle properties of the textile material.

The situation is much the same with hydrophilizing materials, which are cross linked on the fiber to assure adequate permanence of the finish. As a result of the cross linking of the polymers, the handle of the textile materials generally worsens.

German Pat. No. 26 43 637 discloses a method for finishing fiber products containing cellulose fibers with a synthetic resin. In this method, the fiber products are treated with a solution or dispersion of a glycidyl-containing copolymer, whereupon the products are dried and then heat treated in the presence of an acid catalyst, the heating being effected to a temperature sufficient to split the oxiran bond of the glycidyl group. The catalyst is incorporated in the solution or dispersion of the copolymer or is applied before or after the drying step in the form of a separate solution or dispersion. The method is characterized in that a copolymer is used, which comprises:

(a) 1 to 55 mole percent of at least one structure unit of the formula

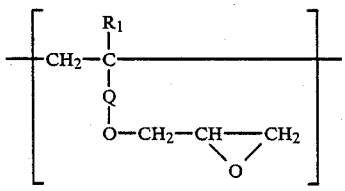

wherein $R_1$ is a hydrogen atom or a methyl group and Q is CO or $CH_2$.

(b) 0.5 to 25 mole percent of at least one structure unit of the formula:

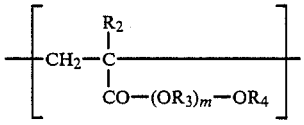

wherein $R_2$ is a hydrogen atom or a methyl group:

$R_3$ is a linear or branched alkylene group with not more than 3 carbon atoms:

$R_4$ is a hydrogen atom, a linear or branched alkyl group, an acryloyl group or a methacryloyl group and m is a whole number from 5 to 25 and (c) 98.5 to 20 mole percent of at least one structure unit of the formula:

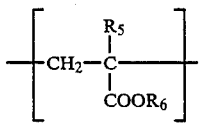

wherein $R_5$ is a hydrogen atom or a methyl group and $R_6$ is a linear or branched alkyl group or a hydroxyalkyl group, as well as optionally (d) up to 10 mole percent of other vinyl-like structure units.

In the German Offenlegungsschrift No. 3,244,011, a water-dispersible polyester is described, which is built up from components of formula wherein A represents, on the statistical average, 80 to 100 mole percent of p-phenylene and 0 to 20 mole percent of a bivalent group of the formula

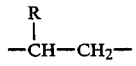

and

G represents, on the statistical average, 30 to 90 mole percent of linear or branched bivalent alkane groups with 3 to 6 carbon atoms, which may also be interrupted by 1 or 2 oxygen atoms, 10 to 30 mole percent of bivalent polyether groups with an average molecular weight of 1,000 to 3,000 and 0 to 50 mole percent of ethylene groups and R represents a linear or branched alkyl group or alkenyl group with 6 to 18 carbon atoms.

The dispersible polyester is intended to be used for the hydrophilization, the antistatic finishing and the soil release finishing of fiber materials, which consist completely or to a considerable extent of hydrophobic fibers.

However, the products used for the method of the German Pat. No. 2,643,637 have the disadvantage that the handle or "touch" of the textile material treated with them is undesirably hard. Moreover, the polymer on the fibers is saponified by the action of alkalis, so that the permanence, that is, the resistance to laundering of the finished textile material is insufficient.

Deficient permanence is also a disadvantage of a finish produced on the basis of a dispersible polyester of the German Offenlegungsschrift No. 3,244,011. This is due to the fact that the polyesters are not cross linked and can therefore easily be detached from the fibers by washing.

A material for the hydrophilic finishing of fibers or fiber products should fulfill the following conditions:

The wear comfort of the textiles should be increased owing to the fact that body moisture can be better dissipated through the fabric to the outside.

The finish should have the highest possible permanence and still have a hydrophilizing effect after a larger number of conventional washing processes.

The ability to soil the textiles should be reduced. It should also be easier to remove existing soil from the textiles.

Graying of white domestic laundry articles is to be reduced.

The electrostatic charge on the textiles should be diminished. The uptake of dust is also minimized in this manner.

OBJECT OF THE INVENTION

It is the primary object of the present invention to provide fiber finishing agents and compositions which, when applied to fibers or fiber products of cellulose or synthetic polymeric compounds, such as polyesters, polyamides or polyacrylonitrile improve the handle while at the same time they also increase the permanence of the obtained finish. In this manner it is insured that the improved handle of the textile material and other improved use properties are retained even after repeated laundering.

It is a further object of the invention to provide finishing agents and compositions of the indicated kind which combine the improvement in the handle with an improvement in the hydrophilicity of the fiber products. Due to the improved hydrophilicity, the wear comfort of the textile materials is increased because body moisture is capable of dissipating in an improved manner through the fabric towards the outside.

A still further object of the invention is to provide finishing agents and compositions of the indicated kind which reduce the soilability and the graying of the textile material.

Further it is an object of the invention to provide finishing agents and compositions, which reduce the tendency of the textile material to develop electrostatic charges.

Generally it is an object of the invention to improve on the art of finishing fibers and fiber products.

SUMMARY OF THE INVENTION

Surprisingly, it has now been ascertained that the above objects are superiorily achieved by a finishing agent, which is made up of the following components:

(a) 34 to 99% by weight of a polymer of the general formula

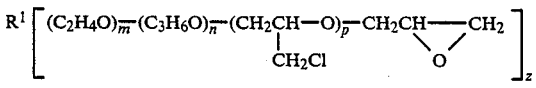

in which $R_1$ is a z-hydric aliphatic alcohol, z=2 to 9, m=20 to 75, n=0 to 10, p=0 to 3, (b) 0 to 55% by weight of a copolymer, obtainable by copolymerization of ($b_1$) one mole of a macromonomer of the general formula

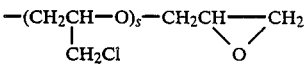

in which q=5 to 75, r=0 to 10, s=0 to 3, with ($b_2$) 2 to 12 moles of a vinyl ester of the general formula $CH_2{=}CHOCOR^2$, in which $R^2$ is an alkyl group with 1 to 4 carbon atoms.

($b_3$) 1 to 6 moles of N-vinylpyrrolidone, ($b_4$) 0 to 6 moles of an acrylate or methacrylate ester of the general formula $CH_3{=}CR^3{-}COOR^4$, in which $R^3$=H or $CH_3$, $R^4$ is an alkyl group with 1 to 4 carbon atoms, the quotient of the average molecular weight of the monomer ($b_1$) and the number of moles of the monomers ($b_2$), ($b_3$) and ($b_4$) being 20 to 500, and (c) 1 to 35% by weight of a compound, which is known as such, is reactive with respect to the oxiran group and brings about the cross linking reaction, the sum of the components (a), (b) and (c) yielding 100% by weight.

Especially preferred is a finishing agent mixture of n 34 to 73% by weight of component (a)

24 to 55% by weight of component (b) and 2 to 30% by weight of component (c)

the sum of components (a), (b) and (c) amounting to 100% by weight.

Component (a) is a polymer of the general formula

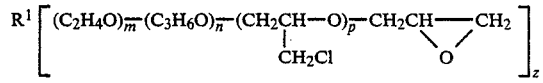

In this formula, $R^1$ represents a z-hydric aliphatic alcohol group, z being a number from 2 to 9 and preferably 4. Examples of such $R^1$ alcohol groups are ethylene glycol, propylene glycol, butylene glycol, hexylene glycol, glycerin, trimethylolpropane, pentaerythritol, sorbitol and the di- tri-, tetra- or oligomers of glycerin, glycidol, trimethylolpropane and pentaerythritol. In each case, the hydrogen atom of the hydroxyl groups is split off. Subscript m indicates the number of oxyethylene units and is a number from 20 to 75 and preferably 25 to 45, while n describes the number of oxypropylene units and is a number from 0 to 10 and preferably from 3 to 6. The oxypropylene units have the function of Preventing the crystallization of the oxyethylene portions and of ensuring that polymer (a) is a liquid. At low oxyethylene contents, therefore, the oxypropylene units may be omitted. Subscript p has a value of 0 to 3. This polymer is synthesized by known methods.

Component (b) is a copolymer, which is obtainable by the copolymerization of monomers ($b_1$), ($b_2$), ($b_3$) and ($b_4$).

Monomer ($b_1$) is produced by the known addition reaction of ethylene oxide and, if necessary, propylene oxide to allyl alcohol and subsequent reaction with epichlorohydrin in the presence of a catonic catalyst, followed by the splitting off of hydrogen chloride with formation of the oxiran ring.

If ethylene oxide and propylene oxide undergo an addition reaction with allyl alcohol, the addition may take place randomly (statistically) or in blocks.

Subscript q indicates the number of hydrophilizing oxyethylene units and is a number from 5 to 75 and preferably from 20 to 50. Subscript r indicates the content of oxypropylene units and is a number from 0 to 10 and preferably from 0 to 6. The task of the oxypropylene units, which are optionally present, is to prevent the formation of crystalline regions in the monomer and to ensure that macromonomer ($b_1$) is a liquid. This is of importance especially when larger proportions of oxyethylene units are contained in the monomer. If the oxyethylene content is relatively low and does not exceed about 18 oxyethylene units, it is possible to do without the oxypropylene units.

Subscript s has a value of 0 to 3.

Monomer ($b_2$) is a vinyl ester of the general formula $CH_2{=}CHOCOR^2$ in which $R^2$ is an alkyl group with 1 to 4 carbon atoms, preferably methyl.

Monomer ($b_3$) is N-vinylpyrrolidone.

Monomer ($b_4$), which is optionally contained in the copolymer, is an acrylate or methacrylate ester of the general formula $CH_2{=}CR^3{-}COOR^4$, in which $R^3$ is hydrogen or methyl, preferably hydrogen and $R^4$ is an alkyl group with 1 to 4 carbon atoms, preferably methyl.

Based on 1 mole of monomer ($b_1$), the copolymer contains 2 to 12 moles and preferably 3 to 6 moles of monomer ($b_2$), as well as 1 to 6 moles and preferably 1.5 to 3 moles of monomer ($b_3$) and, if desired, up to 6 moles but preferably 1.5 to 3 moles of monomer ($b_4$). In addition, the condition must be fulfilled that the quotient of the average molecular weight of monomer ($b_1$) and the total number of moles of the monomers ($b_2$), ($b_3$) and ($b_4$) is 20 to 500 and preferably 40 to 200. If, for example, the average molecular weight of monomer ($b_1$) is 1,000 and 6 moles of monomer ($b_2$), 3 moles of monomer ($b_3$) and 3 moles of monomer ($b_4$) are used, the quotient is $$\frac{1{,}000}{6+3+3} = 83.3$$

Component (c) is a compound, which is reactive with respect to the oxiran groups of components (a) and (b) and brings about their cross linking. Well-known cross-linking agents (curing agents) are suitable for this purpose. Especially suitable are multihydric amines, multihydric amides, multihydric thioalcohols or inorganic or organic acids or their anhydrides. Examples of such compounds are polyamines, such as ethylenediamine, diethylenetriamine, triethylenetetramine and their reaction products with diglycidyl ethers of bisphenol A, polyalkylene oxides with terminal amino groups, dicyandiamide, mercapto group-containing compounds, polyaminoimidazolins, perfluoroalkylcarboxylic acids, perfluoroalkylsulfonic acids, inorganic acids, phthalic anhydride, trimellitic anhydride, and pyromellitic anhydride.

Especially preferred cross linking agents are amines of the general formula $$R^5[(C_3H_6O)_aNH_2]_b \text{ or } R^5[C_2H_4O)_aNH_2]_b$$

In this formula, $R^5$ is a b-hydric alcohol group and b is 2 or 3. Examples of such alcohol groups are ethylene glycol, propylene glycol, butylene glycol, glycerin or pentaerythritol, the hydrogen atom of the hydroxyl group being split off in each case. Subscript a is a number from 4 to 40. The time span, during which the materials of the invention can be processed, can be lengthened substantially, if ammonium compounds, preferably the acetates, are used instead of the free amines.

Considered from another, aspect, the invention provides for a fiber finishing composition, which comprises an aqueous solution containing about between 0.1 to 10% by weight of the inventive agent mixture as effective ingredient with the remainder being water. Pursuant to a preferred embodiment, the inventive composition contains 0.1 to 10% by weight of finishing agent mixture dissolved in water wherein the mixture comprises 34 to 99% by weight of component (a), 0 to 55% by weight of component (b) and 1 to 35% by weight of component (c).

In another preferred embodiment, the aqueous composition comprises 0.1 to 10% by weight of finishing mixture, wherein the mixture is composed of 34 to 73% by weight of component (a), 24 to 55% by weight of component (b) and 2 to 30% by weight of component (c).

It may be reasonably assumed that component (a) improves primarily the handle of the finished textile products. Component (b) by contrast brings about the improvement in the hydrophilicity and the soil-release properties of the finished textile material and contributes significantly to increasing the permanence of the finish. This is presumably also attributable to the fact that component (b) is a graft copolymer with a comb-like structure, with oxiran groups at each end of the side chains formed by monomer ($b_1$). Therefore, when copolymer (b) is cured, products are formed with a relatively high cross linking density, which is independent of the molecular weight. In contrast, the cross linking density of copolymer (a) depends on its molecular weight, since the cross linking density decreases as the content of oxyalkylene groups increases. The properties of polymers (a) and (b) therefore complement one another in that they bring about a balanced relationship of the property parameters of improved handle, hydrophilicity and permanence.

The inventive finishing agents and compositions thus fulfill the initially set requirements of a finish for fibers or fiber products, of improved handle, hydrophilicity and permanence. At the same time, the properties of reduced soilability, reduced graying, improved soil release and reduced electrostatic charging are influenced in the desired manner.

The inventive finishing agents and compositions can be used for the finishing of fibers or fiber products of cellulose (cotton) or of synthetic fibers, such as those from polyesters, polyamides or polyacrylonitrile, as well as of textile fiber materials prepared from these fibers. The usability is, however, not limited to these aforementioned fibers.

The inventive aqueous compositions are applied in a known manner on the fibers. For this purpose, the fibers or fiber products are dipped into the solution or impregnated therewith the solution, subsequently dried and heated to temperatures of 100° to 180° C. and preferably of 120° to 150° C. for 1 to 10 minutes. During this time, the polymer mixture on the fibers is cured.

The preparation of the finishing agents of the invention is described in the following examples, it being understood that these examples are given by way of illustration and not by way of limitation. In addition, the application properties of the inventive compositions containing different finishing agents within the scope of the invention are shown.

1. Synthesis of Component (a)

Finely powdered pentaerythritol (136 g, approx. 1 mole), which has been made into a paste in 150 g of process product, and 11.2 g (approximately 0.2 moles) of potassium hydroxide are mixed carefully and added to a reactor. After extensively flushing with pure nitrogen, the temperature is raised to 110° C., after which 2,500 g (approximately 57 moles) of ethylene oxide are added at such a rate, that the interior of the reactor does not exceed a temperature of 120° C. and a pressure of 6 bar. After all of the ethylene oxide has been introduced, the temperature is maintained at 115° C., until a constant pressure indicates the end of the reaction. After that, the residual monomers are removed by evacuating at 80° to 90° C.

The product obtained is neutralized with the help of dilute phosphoric acid and the water is removed by distillation and the sodium phosphate formed by filtration with the help of a filter aid. The hydroxyl number of the product of the process is 102.5. Assuming a functionality of four, such a hydroxyl number corresponds to a molecular weight of 2190.

The polyether obtained (2,190 g, approximately 1 mole) is heated together with 82 g of a 10.5% solution of boron trifluoride etherate in diethyl ether to a temperature of 60° C. Epichlorohydrin (740 g, approx. 8 moles) is added dropwise to this mixture over a period of ½ hour, the temperature being maintained at 60° C. Subsequently, 2 hours are allowed for reacting out the mixture. In a second step of the reaction, sodium methylate (216 g, approximately 4 moles), dissolved in 510 g of methanol, is added dropwise and the mixture is kept for 2 hours at 25° C.

After removal of the volatile components by distillation, the sodium chloride produced is removed by filtration. The epoxide number of the product obtained is calculated to be the equivalent of 2.92% by weight of active oxygen (Polyether 1-A).

Polyethers 2-A to 8-A are produced similarly. Their compositions are given in Table 1.

TABLE 1

| Polyether No. | Starter Alcohol | Ethylene Oxide Moles | Propylene Oxide Moles | Molecular Weight OH No.* | Epoxide No., O % by wt. |
|---|---|---|---|---|---|
| 1-A | pentaerythritol | 57.0 | — | 2190 | 2.9 |
| 2-A | 1,4-butylene glycol | 36.9 | 4.9 | 1920 | 1.7 |
| 3-A | glycerin | 36.9 | 4.9 | 1890 | 2.6 |
| 4-A | pentaerythritol | 36.0 | 4.8 | 1810 | 3.6 |
| 5-A | pentaerythritol | 21.0 | — | 1080 | 7.7 |
| 6-A | pentaerythritol | 71.0 | 8.0 | 3180 | 1.9 |
| 7-A | sorbitol | 44.8 | 6.0 | 2240 | 4.7 |
| 8-A | sorbitol | 25.5 | 3.4 | 1220 | 9.7 |
| 9-A | tetraglycerin | 52.1 | 7.0 | 2920 | 3.3 |
| 10-A | polyglycerin with molecular weight of approx. 500 | 82.0 | 11.0 | 4280 | 3.0 |

*directly after the alkoxylation

2. Synthesis of Component (b)

2.1 Synthesis of Macromonomer ($b_1$)

Allyl alcohol (116 g, approximately 2 moles) and potassium methylate (21 g, approximately 0.3 moles) are added to a reactor. After flushing carefully with pure nitrogen, the temperature is raised to 110° C. and 1333 g (approximately 30.3 moles) of ethylene oxide is added at such a rate, that the interior of the reactor does not exceed a temperature of 120° C. and a pressure of 6 bar. After all of the ethylene oxide has been introduced, the temperature is maintained at 115° C., until a constant pressure indicates the end of the reaction. After that, the unreacted monomers are removed under vacuum at 80° to 90° C.

The product obtained is neutralized with the help of dilute phosphoric acid and the water is removed by distillation and the sodium phosphate formed by filtration with the help of a filter aid. The hydroxyl number of the product of the process is 89.9. Assuming a functionality of one, such a hydroxyl number corresponds to a molecular weight of 625. From the iodine number, it can be calculated that the double bond content is 96% of the theoretical value.

The polyether obtained (625 g, approximately 1 mole) is mixed with 18 g of a 10.5% solution of boron trifluoride etherate in diethyl ether and the mixture obtained is heated to 60° C. Epichlorohydrin (185 g, approximately 2 moles) is added dropwise to this mixture over a period of ½ hour and the temperature is subsequently maintained at 60° C. for a further 2 hours to complete the reaction, After that, 54 g (approximately 1 mole) of sodium methylate, dissolved in 110 g of methanol is added at about 25° C. and the mixture is reacted at this temperature for 2 hours.

After removal of the volatile components from the reaction mixture by distillation, the sodium chloride obtained is filtered off. The epoxide number of the product obtained corresponds to 2.61% by weight of oxygen (polyether 1-B).

Polyethers 2-B to 10-B are synthesized similarly. Their compositions are given in Table 2.

TABLE 2

| Polyether No. | Ethylene Oxide Moles | Propylene Oxide Moles | Molecular Weight OH No.* | Epoxide No., Oxygen % by wt. |
|---|---|---|---|---|
| 1-B | 15.2 | — | 625 | 2.61 |
| 2-B | 8.8 | — | 440 | 3.76 |
| 3-B | 20.5 | — | 935 | 1.67 |
| 4-B | 24.0 | — | 1110 | 1.39 |
| 5-B | 28.9 | — | 1310 | 1.20 |
| 6-B | 47.8 | — | 2090 | 0.76 |
| 7-B | 12.9 | 1.8 | 720 | 1.87 |
| 8-B | 24.5 | 3.3 | 1305 | 1.09 |
| 9-B | 72.3 | 7.2 | 3320 | 0.46 |
| 10-B | 5.8 | — | 310 | 5.30 |

2.2 Copolymerization of Components ($b_1$), ($b_2$), ($b_3$) and ($b_4$)

Polyether 1-B (600 g, approximately 1 mole), dissolved in 1700 g of ethanol, is heated to 80° C. in a 3-neck flask under a stream of nitrogen. To this is added a mixture of 516 g (approximately 6 moles) of vinyl acetate, 258 g approximately 3 moles) of methyl acrylate and 333 g (approximately 3 moles) of N-vinylpyrrolidone over a period of 3.0 hours. Parallel to this addition, 53.8 g of azodiisobutyrodinitrile is added in 6 equal parts by weight over a period of 5 hours. The temperature is maintained at 80° for a further 8 hours. Subsequently, the unreacted monomers are distilled off under vacuum. From the amount of monomers collected in a cold trap, a polymerization yield of 99% of the theoretical, based on the monomer mixture, can be calculated. The iodine number determination reveals that approximately 75% of 1-B, the polyether, has been consumed in the copolymerization. According to gel-chromatographic analysis, copolymer I has a number average molecular weight of approximately 4,000.

Copolymers II to XII are synthesized similarly. Their composition is given in Table 3.

TABLE 3

| Copolymer No. | Polyether No. | Moles of Vinyl Acetate | Moles of N—Vinylpyrrolidone | Moles of Methyl Acrylate | Quotient |
|---|---|---|---|---|---|
| I | 1-B | 6 | 3 | 3 | 50.0 |
| II | 1-B | 3 | 1.5 | 1.5 | 100.0 |
| III | 1-B | 5 | 2 | 2 | 66.7 |
| IV | 2-B | 6 | 3 | 3 | 34.5 |
| V | 3-B | 6 | 3 | 3 | 75.8 |
| VI | 4-B | 6 | 3 | 3 | 90.4 |
| VII | 5-B | 6 | 3 | 3 | 107.0 |
| VIII | 6-B | 6 | 3 | 3 | 172.0 |
| IX | 7-B | 6 | 3 | 3 | 57.9 |
| X | 8-B | 6 | 3 | 3 | 107.7 |
| XI | 9-B | 4 | 3 | — | 474.3 |
| XII | 10-B | 8 | 4 | 3 | 21.6 |

3. Cross Linking Agents

The following are used as compounds, which bring about cross linking:

TABLE 4

| | |
|---|---|
| 1-C | triethylenetetramine |
| 2-C | reaction product of 2 moles of ethylenediamine and the diglycidyl ether of bisphenol A |

TABLE 4-continued

| | |
|---|---|
| 3-C | α, ω-diaminopolypropylene oxide (MW ≅ 400) |
| 4-C | α, ω-triaminopolypropylene oxide (MW ≅ 400) |
| 5-C | α, ω-diaminopolypropylene oxide (MW ≅ 400) reacted with acetic acid in the molar ratio of 1:2 |
| 6-C | dicyandiamide + 1% triethylenediamine |
| 7-C | polyfunctional sulfhydryl compound, commercially available from Schering under the name of XE 90 |
| 8-C | polyaminoimidazolin, commercially available from Schering under the name of Versamid 140 |
| 9-C | trifluoroacetic acid |
| 10-D | trifluoromethanesulfonic acid |
| 11-C | phosphoric acid |

INVENTIVE FINISHING AGENTS AND COMPOSITIONS

The inventive compositions are prepared by mixing components (a), (b) and (c) and dissolving them in water. The composition of the agent mixtures is given in Table 5.

TABLE 5

| Finishing Agent | Component (a)* No. | Component (a)* % by wt. | Component (b)** No. | Component (b)** % by wt. | Cross Linker (c)*** No. | Cross Linker (c)*** % by wt. |
|---|---|---|---|---|---|---|
| 1 | 1 | 94.1 | — | — | 1 | 5.9 |
| 2 | 1 | 70.5 | — | — | 2 | 29.5 |
| 3 | 1 | 73.3 | — | — | 3 | 26.7 |
| 4 | 1 | 80.5 | — | — | 4 | 19.5 |
| 5 | 1 | 67.8 | — | — | 5 | 32.2 |
| 6 | 4 | 91.5 | — | — | 6 | 8.5 |
| 7 | 4 | 69.3 | — | — | 7 | 30.7 |
| 8 | 4 | 82.6 | — | — | 8 | 17.4 |
| 9 | 1 | 43.1 | I | 43.1 | 4 | 13.8 |
| 10 | 4 | 42.1 | I | 42.1 | 4 | 15.8 |
| 11 | 1 | 40.3 | I | 40.3 | 3 | 19.4 |
| 12 | 7 | 34.3 | I | 34.3 | 5 | 31.4 |
| 13 | 3 | 43.6 | I | 43.6 | 4 | 12.8 |
| 14 | 2 | 45.1 | I | 45.1 | 4 | 9.9 |
| 15 | 1 | 49.5 | I | 49.5 | 11 | 10.0 |
| 16 | 1 | 49.7 | V | 49.7 | 9 | 0.6 |
| 17 | 1 | 49.7 | VI | 49.7 | 10 | 0.6 |
| 18 | 8 | 35.1 | II | 44.5 | 4 | 20.4 |
| 19 | 8 | 39.1 | III | 45.7 | 8 | 15.2 |
| 20 | 3 | 41.8 | VII | 54.5 | 6 | 3.7 |
| 21 | 5 | 46.2 | X | 50.5 | 1 | 3.3 |
| 22 | 5 | 26.3 | XI | 52.7 | 4 | 21.0 |
| 23 | 6 | 44.7 | XII | 44.7 | 4 | 10.6 |
| 24 | 7 | 45.9 | VIII | 49.3 | 1 | 4.8 |
| 25 | 2 | 55.4 | IX | 30.8 | 3 | 13.8 |

*see Table 2
**see Table 3
***see Table 4

TABLE 6

| | Application Testing | | | | | | | |
|---|---|---|---|---|---|---|---|---|
| | Hydrophilicity | | Permanence | | Soil Release[2] | | | |
| Finishing Agent | Droplet [sec] | Rise Height[1] [mm] | After Extraction [% by wt.] | After 5 Lauderings [% by wt.] | Coffee | Black Grape Juice | Used Oil | Handle[3] |
| 1 | 2 | 23 | 78 | 73 | 1 | 2 | 4 | 1 |
| 2 | 8 | 14 | 72 | 66 | 1 | 3 | 3 | 2 |
| 3 | 2 | 24 | 77 | 70 | 1 | 2 | 2 | 1 |
| 4 | 2 | 23 | 85 | 75 | 1 | 3 | 3 | 1 |
| 5 | 2 | 25 | 76 | 68 | 1 | 3 | 1 | 1 |
| 6 | 2 | 21 | 53 | 45 | 1 | 2 | 4 | 1 |
| 7 | 3 | 22 | 72 | 68 | 1 | 2 | 3 | 1 |
| 8 | 3 | 20 | 58 | 50 | 1 | 4 | 4 | 2 |
| 9 | 3 | 22 | 64 | 54 | 1 | 1 | 1 | 2 |
| 10 | 3 | 22 | 67 | 56 | 1 | 1 | 1 | 2 |
| 11 | 3 | 23 | 60 | 51 | 1 | 1 | 1 | 1 |
| 12 | 2 | 21 | 71 | 63 | 1 | 1 | 1 | 1 |
| 13 | 3 | 24 | 51 | 43 | 1 | 1 | 1 | 2 |
| 14 | 3 | 22 | 42 | 21 | 1 | 1 | 1 | 2 |
| 15 | 2 | 24 | 26 | 18 | 1 | 1 | 1 | 2 |
| 16 | 3 | 22 | 36 | 31 | 1 | 3 | 2 | 2 |

TABLE 6-continued

| Finishing Agent | Hydrophilicity Droplet [sec] | Hydrophilicity Rise Height[1] [mm] | Application Testing Permanence After Extraction [% by wt.] | Application Testing Permanence After 5 Lauderings [% by wt.] | Soil Release[2] Coffee | Soil Release[2] Black Grape Juice | Soil Release[2] Used Oil | Handle[3] |
|---|---|---|---|---|---|---|---|---|
| 17 | 7 | 19 | 33 | 29 | 1 | 2 | 2 | 2 |
| 18 | 3 | 21 | 77 | 72 | 1 | 1 | 1 | 2 |
| 19 | 3 | 20 | 75 | 69 | 1 | 1 | 1 | 1 |
| 20 | 3 | 22 | 43 | 35 | 1 | 2 | 2 | 1 |
| 21 | 2 | 21 | 76 | 68 | 1 | 1 | 1 | 2 |
| 22 | 2 | 20 | 74 | 66 | 1 | 1 | 1 | 2 |
| 23 | 3 | 21 | 58 | 51 | 1 | 2 | 3 | 1 |
| 24 | 3 | 22 | 69 | 64 | 1 | 1 | 1 | 2 |
| 25 | 3 | 21 | 35 | 27 | 1 | 3 | 2 | 1 |
| untreated fabric | >120 | 0 | — | — | 2 | 2 | 6 | 2 |

[1]after the first minute
[2]evaluation:
1 = very good, complete removal
2 = good, slight residues
3 = satisfactory, weak spot
4 = adequate, distinct spot
5 = hardly any cleaning effect
6 = unchanged
[3]1 = very soft
2 = soft
3 = average
4 = hard

We claim:

1. A finishing agent for finishing fibers or fiber products comprising a mixture of the following components:

(a) 34 to 99% by weight of a polymer of the general formula $$R^1\left[(C_2H_4O)_m-(C_3H_6O)_n-(CH_2CH-O)_p-CH_2CH-CH_2\right]_z$$

(CH₂CL, O)

wherein $R^1$ is a z-hydric aliphatic alcohol with z=2 to 9, m=20 to 75, n=0 to 10, p=0 to 3;

(b) 0 to 55% by weight of a copolymer, obtained by copolymerization of ($b_1$) one mole of a macromonomer of the general formula $$CH_2=CH-CH_2O(C_2H_4O)_q-(C_3H_6O)_r-$$

$$-(CH_2\underset{\underset{CH_2Cl}{|}}{CH}-O)_s-CH_2CH\underset{O}{\diagup\diagdown}CH_2$$

wherein q=5 to 75, r=0 to 10, s=0 to 3, with ($b_2$) 2 to 12 moles of a vinyl ester of the general formula $CH_2=CHOCOR^2$, in which $R^2$ is alkyl with 1 to 4 carbon atoms, ($b_3$) 1 to 6 moles of N-vinylpyrrolidone, and ($b_4$) 0 to 6 moles of an acrylate or methacrylate ester of the general formula $CH_3=CR^3-COOR^4$, wherein $R^3=H$ or $CH_3$, $R^4$ is alkyl with 1 to 4 carbon atoms, with the proviso that the quotient of the average molecular weight of the monomer ($b_1$) and the number of moles of the monomers ($b_2$), ($b_3$) and ($b_4$) is 20 to 500;

(c) 1 to 35% by weight of a compound, which is reactive with respect to oxiran groups and causes a cross linking reaction the sum of the components (a), (b) and (c) yielding 100% by weight.

2. The finishing agent of claim 1, wherein said mixture comprises about between 34 to 73% by weight of component (a)
24 to 55% by weight of component (b) and
2 to 30% by weight of component (c)

the sum of components (a), (b) and (c) yielding 100% by weight.

3. The finishing agent of claims 1 or 2, wherein for polymer (a) m=25 to 45, n=3 to 6, z=4 and $R^1$ is a group derived from pentaerythritol.

4. The finishing agent of claims 1 or 2, wherein copolymer (b) is obtained by copolymerization of one mole of component, ($b_1$), 3 to 6 moles of component ($b_2$), 1.5 to 3 moles of component ($b_3$) and 1.5 to 3 moles of component ($b_4$), the quotient of the average molecular weight of monomer ($b_1$) and the number of moles of monomers ($b_2$), ($b_3$) and ($b_4$) being 40 to 200.

5. The finishing agent of claims 1 or 2 wherein in monomer $b_1$ q=20 to 50 and r=0 to 6.

6. The finishing agent of claims 1 or 2 wherein $R^2$ is methyl in monomer ($b_2$).

7. The finishing agent of claims 1 or 2 wherein $R^3$ is a hydrogen atom and $R^4$ is methyl in monomer ($b_4$).

8. The finishing agent of claims 1 or 2 wherein the compound, which causes the cross linking reaction, is a multihydric amine, a multihydric amide, a multihydric thioalcohol or an acid.

9. The finishing agent of claims 1 or 2 wherein the compound, which causes the cross linking reaction, is an amine of the general formula $$R^5[(C_3H_6O)_aNH_2]_b \text{ or } R^5[(C_2H_4O)_aNH_2]_b$$

wherein $R^5$ is a b-hydric alcohol group, a is 4 to 40 and b is 2 or 3.

10. A finishing agent for finishing fibers and fiber products, comprising a mixture of the following components:

(a) 34 to 99% by weight of a polymer of the general formula

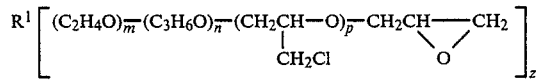

wherein $R^1$ is a z-hydric aliphatic alcohol, in which z=4, m=25–45, n=3–6 and p=0–3;

(b) 0 to 55% by weight of a copolymer obtained by the copolymerization of ($b_1$) one mole of a macromonomer of the general formula

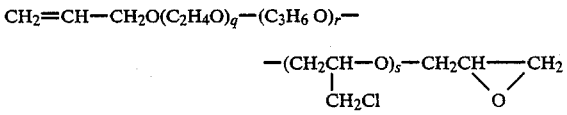

wherein q=20–50, r=0–6, and s=0–3, ($b_2$) 2 to 12 moles of a vinyl ester of the general formula $CH_2{=}CHOCOR^2$, wherein $R^2$ is methyl, ($b_3$) 1 to 6 moles of N-vinylpyrrolidone and ($b_4$) 0 to 6 moles, of an acrylate or methacrylate ester of the general formula $CH_3{=}CR^3{-}COOR^4$, wherein $R^3$ is hydrogen and $R^4$ is methyl, with the proviso that the quotient of the average molecular weight of the monomer ($b_1$) and the number of moles of ($b_2$), ($b_3$) and ($b_4$) is 40–200: and (c) 1 to 35% by weight of a cross-linker of the formula $$R^5[(C_3H_6O)_aNH_2]_b \text{ or } R^5[(C_2H_4O)_aNH_2]_b$$

wherein $R^5$ is a b-hydric alcohol, a=4–40 and b=2 or 3. the sum of components (a), (b) and (c) yielding 100% by weight.

11. A finishing composition for finishing fibers or fiber products comprising an aqueous solution of about between 0.1 to 10% by weight of the finishing agent of claims 1, 2 or 10 with the remainder being water.

12. A method of finishing fibers or fiber products which comprises applying to the fibers or fiber products the composition of claim 11, drying the fibers or fiber products and then heating them to a temperature of between about 100°–180° C.

13. The products obtained by the method of claim 12.

* * * * *